United States Patent [19]

Wingert

[11] Patent Number: 4,982,586

[45] Date of Patent: Jan. 8, 1991

[54] COMBINATION LOCK THAT PREVENTS SHOCK-FORCE RELEASE OF A HASP

[75] Inventor: Rudolf Wingert, West Milford, N.J.

[73] Assignee: Presto Lock, Inc., Garfield, N.J.

[21] Appl. No.: 531,753

[22] Filed: Jun. 1, 1990

[51] Int. Cl.[5] ..... E05B 37/02

[52] U.S. Cl. ..... 70/312; 70/321

[58] Field of Search ..... 70/312, 68–76, 70/320, 321, 322

[56] References Cited

U.S. PATENT DOCUMENTS

| | | | |
|---|---|---|---|
| 4,308,731 | 1/1982 | Remington | 70/74 |
| 4,711,108 | 12/1987 | Garro | 70/312 |
| 4,829,796 | 5/1989 | Kim | 70/312 |
| 4,854,139 | 8/1989 | Scelba | 70/68 |
| 4,856,306 | 8/1989 | Scelba | 70/68 |

*Primary Examiner*—Robert L. Wolfe

*Attorney, Agent, or Firm*—Shapiro and Shapiro

[57] ABSTRACT

A combination lock has a pivoting bolt for engaging and disengaging a hasp. The hasp, which is disengaged from the bolt when the lock is on-combination, may be re-engaged with the bolt, even if the lock is off-combination. A first spring resiliently biases the bolt to an unlocked position. A second spring resiliently restrains movement of the bolt beyond a locked position in order to prevent disengagement of the hasp in response to application of a shock force to the lock.

5 Claims, 4 Drawing Sheets

COMBINATION LOCK THAT PREVENTS SHOCK-FORCE RELEASE OF A HASP

BACKGROUND OF THE INVENTION

This invention is concerned with combination locks of the type commonly used in luggage and the like and is more particularly concerned with a combination lock that prevents the undesired release of a hasp in response to the application of a shock force to the lock.

A well known type of combination lock employs a group of dial units for controlling the disposition of a pivoting bolt that is engageable with a hasp. The lock may be mounted on a sidewall of the body of a luggage case, for example, and the hasp may be mounted on a corresponding sidewall of the lid or cover of the case. When the hasp is engaged with the bolt of the lock and the lock is off-combination, the lid is locked closed. When the lock is on-combination, the hasp is released by the bolt so that the lid may be opened.

After the lid is opened, the lock may be set off-combination ("scrambled"), either intentionally to prevent observation of the opening combination of the lock, or inadvertently. It is desirable that the lock construction permit the hasp to be re-engaged with the bolt of the lock even when the lock is off-combination. This is sometimes referred to as a "scramble" feature. For this purpose, combination locks have been constructed so that the bolt may be moved beyond its locked position by contact with the hasp and then be returned to its locked position by the usual bolt-biasing spring. Although the scramble feature is highly desirable, there is a detriment in that the bolt may be moved beyond its locked position and release the hasp in response to application of a shock force to the lock. In other words, the lock may be opened undesirably.

BRIEF DESCRIPTION OF THE INVENTION

The combination lock of the present invention has a scramble feature but nevertheless prevents undesired opening of the lock in response to shock forces.

In one of its broader aspects, a combination lock of the invention comprises a bolt pivotally supported near one end, the bolt being disposed at an unlocked position or a locked position spaced therefrom, depending upon whether the lock is on-combination or off-combination, respectively, the bolt having an opposite end adapted to engage a hasp when the bolt is in the locked position and to disengage the hasp when the bolt is in the unlocked position, first spring means for biasing the bolt toward the unlocked position, the bolt being capable of being moved beyond the locked position and farther from the unlocked position by contact of the opposite end of the bolt with the hasp after the hasp has been disengaged from the bolt, and then being returned to the locked position by the bias of the first spring means, whereby the hasp may be re-engaged with the bolt when the lock is off-combination, and second spring means for resiliently restraining movement of the bolt beyond the locked position to prevent disengagement of the hasp from the bolt in response to application of a shock force to the lock.

BRIEF DESCRIPTION OF THE DRAWINGS

The invention will be further described in conjunction with the accompanying drawings, in which.

DETAILED DESCRIPTION OF PREFERRED EMBODIMENT

Figure 1:
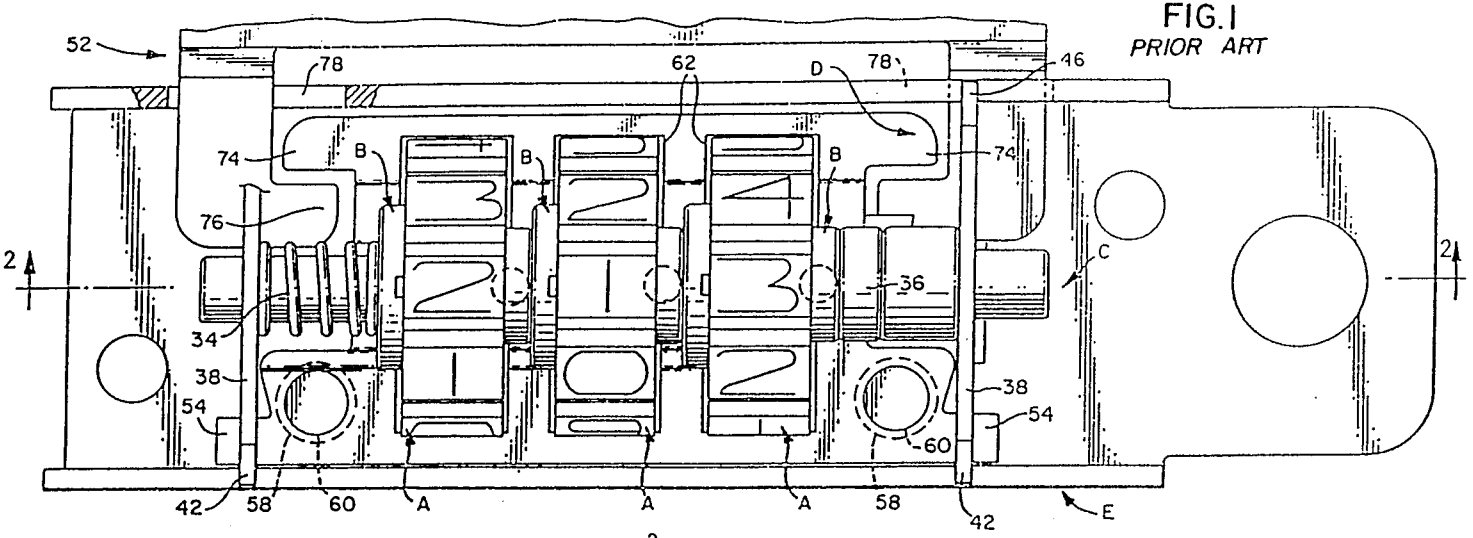
FIG. 1 PRIOR ART
FIG. 1 is a top plan view, partially broken away, illustrating a pivoting bolt combination lock of the prior art, the lock being illustrated in association with a hasp (partially shown)

Before the combination lock of the invention is described in detail, a prior combination lock will be described to provide a more specific background of the invention. FIGS. 1–7 illustrate a prior combination lock disclosed in U.S. Pat. No. 4,308,731 assigned to the assignee of the present invention. Principal parts of the lock include combination dials A, sleeves B, a shaft C, a bolt D, and a frame E.

Each dial A is supported on shaft C by a corresponding sleeve B. The dials have internal gear teeth 30 (FIG. 5) that mesh with external gear teeth 32 of the sleeves. The sleeves are held in successive abutting relationship by a coil compression spring 34 on the shaft, which urges the sleeves toward a collar 36 integral with the shaft. Opposite ends of the shaft are supported upon brackets 38, one of which is shown in detail in FIG. 7. Each bracket has a hole 40 into which the corresponding end of shaft C is inserted. Spring 34 is compressed between one of the brackets and an adjacent sleeve as shown in FIG. 2.

Figure 3:
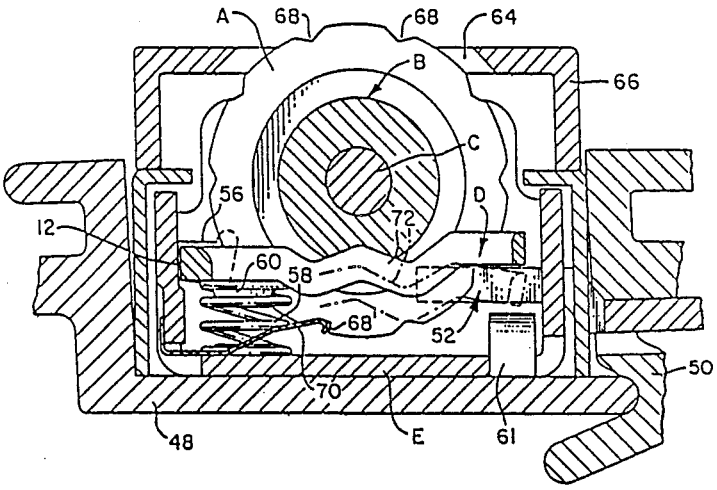
FIG. 3 PRIOR ART
FIG. 3 is a vertical sectional view taken along line 3—3 of FIG. 2, this view also illustrating a cover for the lock and valance members adapted to be mounted on luggage or the like to which the lock may be attached.

Frame E is generally U-shaped in cross-section, as shown in FIG. 3, and each bracket 38 has protrusions 42, 44, and 46 that enter corresponding slots in the adjacent walls of the frame. The frame is supported on a valance member 48 (FIG. 3) applied to an edge of part of a luggage case, for example, in a conventional manner. A mating valance member 50, applied to an edge of another part of the luggage case, supports a hasp 52 in a conventional manner, as indicated in FIGS. 1 and 3. The parts of the luggage case may be hingedly connected, and may be held closed, one upon the other, by engagement of hasp 52 with bolt D.

The bolt is supported along an edge 12 for pivotal movement relative to the frame and the assembly of dials and sleeves. This is accomplished by providing lugs 54 at opposite ends of the bolt that are received in slots 56 of brackets 38. The slots are shaped to accommodate the pivotal movement of the bolt. Coil compression springs 58 adjacent to opposite ends of the bolt near edge 12 are positioned between the bolt and frame to bias the bolt toward the sleeves. The bolt has locating bosses 60 for the springs. A stop 61 limits movement of the bolt away from the sleeves.

Figure 2:
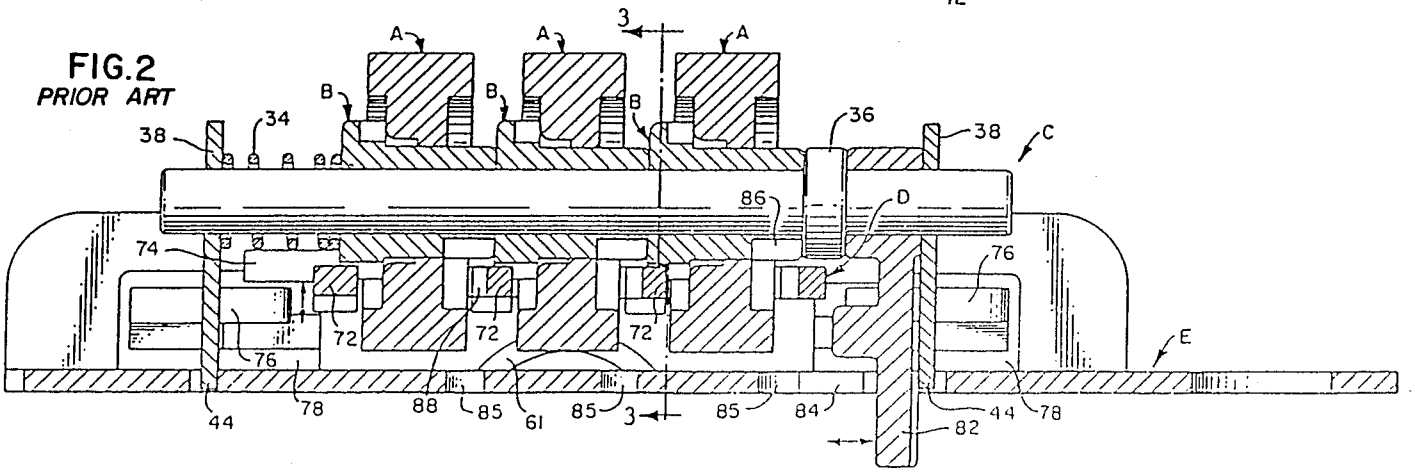
FIG. 2 PRIOR ART
FIG. 2 is a vertical sectional view taken along line 2—2 of FIG. 1.
Figure 4:
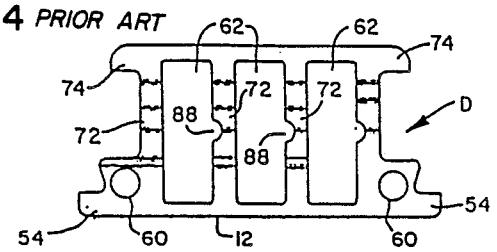
FIG. 4 PRIOR ART
FIG. 4 is a top plan view of a pivoting bolt employed in the lock of the prior art.

As shown in FIGS. 1, 2 and 4, the bolt has a series of openings 62 freely receiving the dials A so that the bolt may engage sleeves B without interference from the dials. The dials also protrude through corresponding openings 64 in a cover plate 66 (see FIG. 3) where the combination indicia of the dials are displayed to the user. Each dial has ten combination numbers equally spaced about its circumference, with successive members separated by indexing notches 68. The indexing notches cooperate with arms of a dial spring 70 as shown in FIG. 3. The dial spring has its base supported in a slot of the frame and has a resilient arm for each dial that enters the indexing notches of that dial. The indexing notches are symmetrical V-shape notches, but one notch, 68', has a radial surface that engages the associated arm of the dial spring to stop rotation of the dial when the dial is rotated in a given direction (clockwise in FIG. 3) to a particular rotational position. This feature permits rapid setting of all the dials to a zero position, for example.

Figure 5:
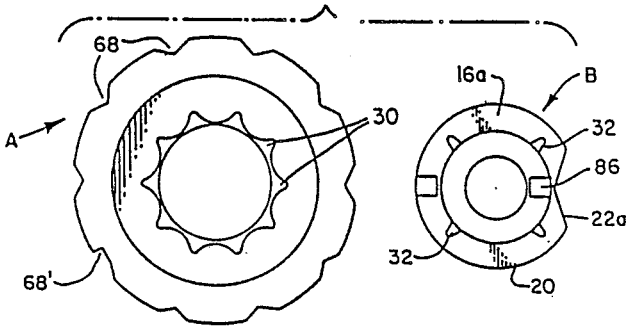
FIG. 5 PRIOR ART
FIG. 5 is an end view of a dial and associated flanged sleeve employed in the lock of the prior art.
Figure 6:
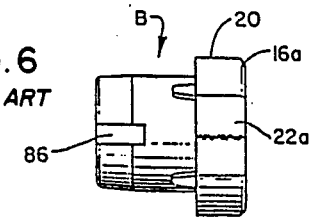
FIG. 6 PRIOR ART
FIG. 6 is a side elevation view of the sleeve of FIG. 5.
Figure 7:
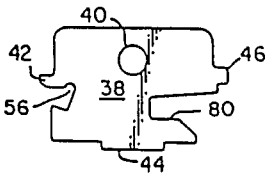
FIG. 7 PRIOR ART
FIG. 7 is a plan view of a bracket employed for supporting parts of the prior art lock mechanism on a frame.

Each of the sleeves B has a flange forming a cam 16*a* (FIGS. 5 and 6). The flange has a circular periphery 20 with a V-shaped notch 22*a*. As shown in FIGS. 3 and 4, bolt D has a ridge 72 with portions that mate with corresponding notches 22*a* when the sleeves are turned to the rotational position of FIG. 3 (unlocked bolt position). The bolt has latching lugs 74 adapted to engage corresponding lugs 76 (see FIG. 1) of the hasp, but when the bolt is in the unlocked position of FIG. 3, there is no engagement with the hasp. Lugs 76 of the hasp enter the frame E via slots 78 and are received in slots 80 of brackets 38 (see FIG. 7) tapered to guide lugs 76 to a predetermined position when the parts of the luggage case are closed.

When the bolt is in the full-line position of FIG. 3, all of the dials are on-combination and the lock is opened. If any dial is turned off-combination, the corresponding cam 16*a* will move the bolt to the phantom line (locked) position shown in FIG. 3, positioning latching lugs 74 of the bolt for engagement with the corresponding lugs 76 of the hasp and preventing withdrawal of the hasp from the frame E.

The combination lock includes a mechanism permitting the user to change the combination when the dials are on-combination. This mechanism comprises a lever 82 (see FIG. 2) mounted on shaft C and protruding through a slot 84 in the frame. By moving lever 82 to the left in FIG. 2 against the bias of spring 34, the sleeves B may be moved to the left relative to the corresponding combination dials A to disengage the gear teeth 32 of the sleeves from the gear teeth 30 of the dials. If lever 82 is held in its leftward position (it may be so held by turning it slightly and engaging it with a branch of slot 84), the combination dials may be turned independently of the sleeves and set to a new combination. When lever 82 is returned to the position illustrated in FIG. 2 (under the bias of the spring 34) the sleeves will be reengaged with the dials and the lock will operate in its normal manner, but with a new combination.

The combination lock also has a combination "finding" feature that permits the combination to be determined when the lock has been opened and the dials scrambled (set off-combination). For this purpose, the frame has holes 85 for receiving a probe, and the sleeves have recesses 36 into which the probe may be inserted when the sleeves are turned to their unlocked position. Bolt D has recesses 88 (see FIG. 4) for passing the probe.

As stated earlier, the stop 61 (FIGS. 2 and 3) limits movement of the bolt D away from the sleeves B. This construction prevents unintentional or unauthorized release of the hasp in response to shock forces applied to the top of the lock. However, such movement is desirable in order to permit the hasp 52 to be re-engaged with the bolt D while the lock is off-combination, i.e., while the combination is "scrambled." The combination lock of the present invention is constructed to permit the hasp to be re-engaged with the bolt while the lock is off-combination, but to prevent undesired disengagement of the hasp in response to the application of shock forces to the lock. In the following description of the combination lock of the invention, similarities between certain parts of the lock and the prior lock described earlier will become apparent, as will important differences.

As shown in FIGS. 8–12, the combination lock of the invention comprises a base 100, including a frame E' and a cover 66', a shaft C', a plurality of dial units 102, each including a combination dial A' and a sleeve B', a pivoting bolt D' and a dial spring 70'. The frame is essentially an open-top rectangular box having oppositely directed flanges 104 by which the frame may be attached to a luggage case, for example. The cover has an inverted U-shape with sidewalls 106 depending from a top wall 108 to the bottom 110 of the frame. Opposite ends 112,114 of the top wall (above open sides of the cover) have projections 116 that are received within notches (not shown) at the upper edges of the sidewalls 118 and 119 of the frame to retain the cover on the frame.

The shaft C' extends between the sidewalls 106 of the cover through corresponding openings therein. The top wall 108 of the cover has a series of openings 64' through which the dials A' protrude for a manipulation by the user. Each dial is supported on the shaft by the associated sleeve B' and rotates therewith in the same manner as the prior lock. Each sleeve has a circular flange 16*a*' provided with a V-shaped notch 22*a*' (or a flat) as in the prior lock. In order to change the opening combination of the lock a shift lever 82' (FIGS. 11 and 12) is moved to compress a spring 34' on the shaft and to shift the series of abutting sleeves B' axially of the shaft so as to disengage the sleeves from the dials, thereby permitting the dials to be turned relative to the sleeves to select a new opening combination, as in the prior lock. The shaft C' of the present invention has a head 120 at one end, followed by a collar 122. The opposite end of the shaft has a spacer sleeve 124 thereon supporting the spring 34'. The shift lever 82' is attached to the shaft by expanding the tip 126 of the shaft that extends beyond the lever.

Figure 17:
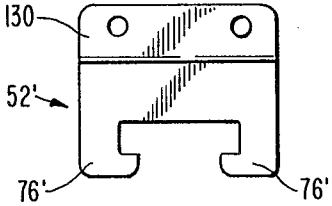
FIG. 17 is an enlarged top plan view of a hasp employed with the combination lock of the invention.
Figure 13:
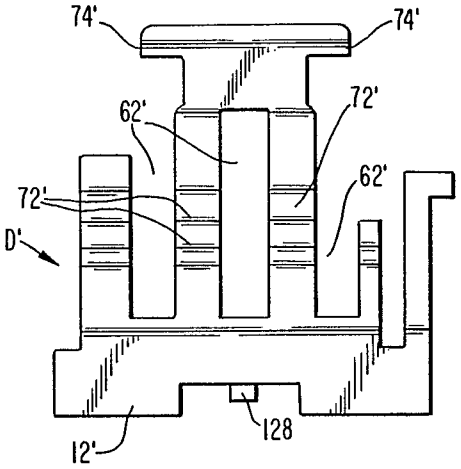
FIG. 13 is an enlarged top plan view of a pivoting bolt employed in the lock of the invention.

Near one end 12' (FIG. 13) the bolt D is pivotally supported by notches 56' (FIG. 12) in the sidewalls 106 of the cover. The bolt has openings 62' through which the dials A' depend and has ridge portions 72' that underlie respective sleeves B' and that complement the V-shaped notches of the associated sleeves, as in the prior lock. A coil spring 58' is mounted on a tang 128 at the end 12' of the bolt and is compressed against the top wall 108 of the cover. This spring resiliently biases the bolt against the sleeves. The opposite end of the bolt, which is free, has a pair of outwardly directed lugs 74'. These lugs are adapted to engage and retain the hasp 52' shown in FIGS. 17 and 18

Figure 18:
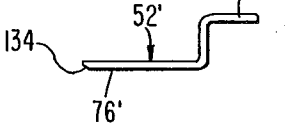
FIG. 18 is an end elevation view of the hasp of FIG. 17.
Figure 14:
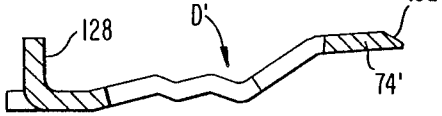
FIG. 14 is an end elevation view (partly in section) of the bolt of FIG. 13.

The hasp has a base 130 adapted to be attached to the lid of a luggage case, for example, and has a pair of inwardly directed lugs 76' adapted to lock behind the lugs 74' of the bolt. The lugs of the hasp engage the lugs of the bolt via openings 78' (FIG. 10) in the sidewall 118 of the frame. As shown in FIGS. 14 and 18, the lugs 74' of the bolt and the lugs 76' of the hasp have cooperable chamfered leading edges 132 and 134, for a purpose that will become apparent hereinafter.

When the dials A' are set on-combination, i.e., to the opening combination of the lock, the V-shaped notches of the sleeves B' are aligned with the corresponding ridge portions of the bolt D' so that the bolt, under the bias of the spring 58', assumes its locked position (at which the bolt is relatively close to the shaft C'). When any dial A' is turned off-combination, its sleeve B' moves the bolt to its locked position (at which the bolt is relatively far from the shaft).

Assuming that the lock is off-combination, so that the bolt is in its locked position and the lugs of the hasp are engaged with the lugs of the bolt, if the dials are then set on-combination, the bolt will be moved so as to disengage the lugs of the bolt from the lugs of the hasp and to release the hasp. The hasp may, of course, be re-engaged with the bolt by inserting the lugs of the hasp into the openings 78' and then setting one or more of the dials off-combination, whereby the bolt is returned to its locked position.

However, as stated earlier, it is desirable that the hasp be capable of re-engagement with the bolt while the lock is off-combination, i.e., it is desirable that the lock have a so-called "scramble" feature. The combination lock of the present invention provides this feature. When the lock is off-combination, so that the bolt is in its locked position, the hasp, which has previously been disengaged from the bolt, may be re-engaged with the bolt by inserting the lugs 76' of the hasp into the openings 78'. In the course of this insertion, the chamfered edges 134 of these lugs contact the corresponding chamfered edges 132 of the bolt lugs 74' so as to move the bolt farther away from the shaft, moving the bolt out of contact with the sleeves. When the hasp lugs are fully inserted, the bolt snaps back to its locked position, under the bias of the spring 58', thereby retaining the hasp engaged with the bolt.

Figure 9:
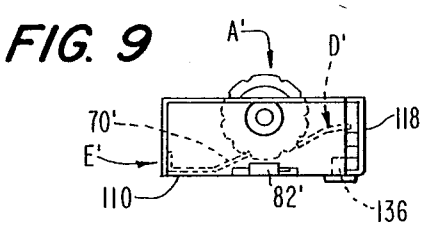
FIG. 9 is an end elevation view of the lock of FIG. 8.
Figure 10:
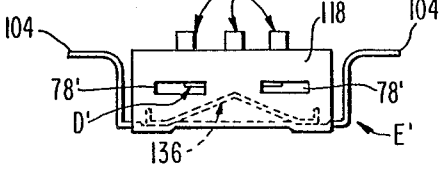
FIG. 10 is a side elevation view of the lock of FIG. 8.
Figure 12:
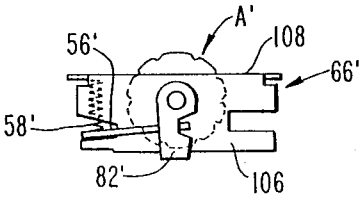
FIG. 12 is an end elevation view of the mechanism of FIG. 11.
Figure 8:
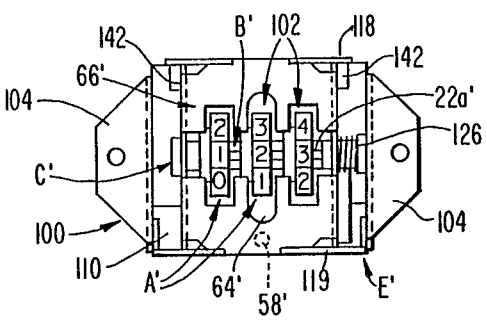
FIG. 8 is a top plan view of a combination lock in accordance with the present invention.
Figure 11:
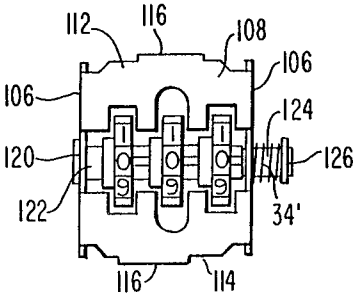
FIG. 11 is a top plan view of a mechanism employed in the lock of the invention.
Figure 15:
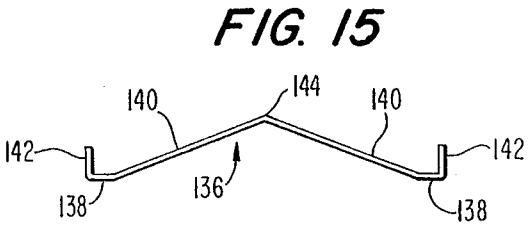
FIG. 15 is an enlarged side elevation view of a spring employed in the lock of the invention.
Figure 16:
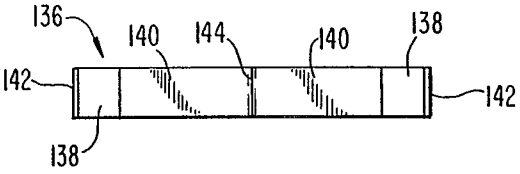
FIG. 16 is a top plan view of the spring of FIG. 15.

The force of the spring 58' cannot be so great as to impede the turning of the dials from their on-combination positions. Accordingly, this spring does not provide a strong restraint on the movement of the bolt beyond its locked position (toward the bottom 110 of the frame). Therefore, in a prior lock having a scramble feature, if the hasp is engaged with the bolt and a shock force is applied to the cover, the bolt may be momentarily moved away from the sleeves and beyond its locked position so as to release the hasp. To prevent this occurrence, the present invention employs an additional spring 136 (see FIGS. 15 and 16) to restrain such hasp-releasing movement of the bolt.

additional spring 136 is a leaf spring of inverted V-shape. The bottoms 138 of the legs 140 of the spring are supported on the bottom 110 of the frame and have tips 142 that embrace the sidewalls 106 of the cover, as shown in FIGS. 8–10. The vertex 144 of the spring is located at or slightly below the level of the openings 78' and is positioned beneath the level of the bolt lugs 74'.

When the lock is off-combination and the lugs 76' of the hasp are inserted into the openings 78', so as to depress the bolt, the bolt contacts the vertex 144 of the spring 136, deflecting the spring slightly as the lugs of the hasp override the lugs of the bolt. The spring only comes into play in the foregoing circumstances and does not impede movement of the bolt from its unlocked position to its locked position. Therefore, turning of the dials from their on-combination positions to off-combination positions is unimpeded. Nevertheless, the resilient restraint imposed on the bolt by the spring 136 is sufficient to prevent hasp-releasing movement of the bolt in response to the application of a shock force to the lock. This is achieved quite simply and effectively in accordance with the invention.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A combination lock comprising a bolt pivotally supported at one end, said bolt being disposed at an unlocked position or a locked position spaced therefrom, depending upon whether said lock is on-combination or off-combination, respectively, said bolt having an opposite end adapted to engage a hasp when said bolt is in said locked position and to disengage said hasp when said bolt is in said unlocked position, first spring means for biasing said bolt toward said unlocked position, said bolt being capable of being moved beyond said locked position and farther from said unlocked position by contact of said opposite end of said bolt with said hasp after said hasp has been disengaged from said bolt, and then being returned to said locked position by the bias of said first spring means, whereby said hasp may be re-engaged with said bolt when said lock is off-combination, and second spring means for resiliently restraining movement of said bolt beyond said locked position to prevent disengagement of said hasp from said bolt in response to application of a shock force to said lock.

2. A combination lock in accordance with claim 1, wherein said second spring means is a V-shaped leaf spring having a vertex disposed for contact with said opposite end of said bolt when said bolt is moved beyond said locked position by said hasp.

3. A combination lock in accordance with claim 1 further comprising a base having a shaft supported thereon, a plurality of combination dial units rotatably supported on the shaft, each dial unit including a dial and a sleeve, wherein said bolt is pivotally supported on said base for movement toward and away from said shaft and said first spring means biases said bolt into engagement with said sleeves, and wherein said sleeves have a configuration whereby when said dials are set on-combination, said bolt is closer to said shaft than when any of said dials is set off-combination.

4. Apparatus comprising a combination lock and a hasp, said combination lock comprising a bolt pivotally supported at one end, said bolt being disposed at an unlocked position or a locked position spaced therefrom, depending upon whether said lock is on-combination or off-combination, respectively, said bolt having an opposite end adapted to engage said hasp when said bolt is in said locked position and to disengage said hasp when said bolt is in said unlocked position, first spring means for biasing said bolt toward said unlocked position, said bolt being capable of being moved beyond said locked position and farther from said unlocked position by contact of said opposite end of said bolt with said hasp after said hasp has been disengaged from said bolt, and then being returned to said locked position by the bias of said first spring means, whereby said hasp may be re-engaged with said bolt when said lock is off-combination, and second spring means for resiliently restraining movement of said bolt beyond said locked position to prevent disengagement of said hasp from said bolt in response to application of a shock force to said lock, said opposite end of said bolt and said hasp having cooperable leading edges that are configured to facilitate overriding of said bolt by said hasp as said hasp contacts said opposite end of said bolt for re-engagement of said hasp with said bolt when said lock is off-combination.

5. A combination lock in accordance with claim 4, wherein said second spring means is a V-shaped leaf spring having a vertex disposed for contact with said opposite end of said bolt when said bolt is moved beyond said locked position by said hasp.

* * * * *